US010636401B2

(12) United States Patent
Leff et al.

(10) Patent No.: US 10,636,401 B2
(45) Date of Patent: Apr. 28, 2020

(54) MODULAR USER-CUSTOMIZABLE MUSIC PEDAL

(71) Applicant: Aryzn, Inc., Atlanta, GA (US)

(72) Inventors: Jeremy Leff, Honolulu, HI (US); Stephen Dallas Condra, Longview, TX (US)

(73) Assignee: Aryzn Inc., Atlanta, GA (US)

( * ) Notice: Subject to any disclaimer, the term of this patent is extended or adjusted under 35 U.S.C. 154(b) by 0 days.

(21) Appl. No.: 15/968,719

(22) Filed: May 1, 2018

(65) Prior Publication Data

US 2018/0330706 A1 Nov. 15, 2018

Related U.S. Application Data

(60) Provisional application No. 62/503,930, filed on May 9, 2017, provisional application No. 62/618,428, filed on Jan. 17, 2018.

(51) Int. Cl.
*G10H 1/32* (2006.01)
*G10H 1/34* (2006.01)
(Continued)

(52) U.S. Cl.
CPC ..... *G10H 1/348* (2013.01); *G10H 1/0008* (2013.01); *G10H 1/0091* (2013.01); *G10H 1/053* (2013.01);
(Continued)

(58) Field of Classification Search
CPC ..... G10H 1/0091; G10H 1/02; G10H 1/32; G10H 2240/165; G10H 1/0033; G10H 2210/231; G10H 2210/281; G10H 2250/641; G10H 2210/235; G10H 2240/056; G10H 2240/285; G10H 2240/305; G10H 1/00; G10H 1/36; G10H 1/361; G10H 1/366; G10H 2210/066; G10H 2210/311; G10H 2210/315; G10H 2210/325; G10H 2210/155; G10H 2210/295; G10D 1/00
See application file for complete search history.

(56) References Cited

U.S. PATENT DOCUMENTS 6,538,185 B1 * 3/2003 Stratton ..... G10H 1/32 84/422.1
8,338,689 B1 * 12/2012 Beaty ..... G10H 1/0091 84/718

(Continued)

*Primary Examiner* — Marlon T Fletcher
(74) *Attorney, Agent, or Firm* — Van Pelt, Yi & James LLP

(57) ABSTRACT

A user-customizable modular music effects pedal is described. The music effects pedal includes a base having an input, an output and a connector. The input receives a music signal. The connector is coupled with the input and has an electrical form factor and a physical form factor. The electrical form factor is configured to fit a corresponding electrical form factor of an effects cartridge. The physical form factor is configured to fit a corresponding physical form factor of the effects cartridge. The connector provides the music signal to the effects cartridge and receiving a processed signal from the effects cartridge. The effects cartridge includes effects electronics to provide the processed signal. The output is coupled with the connector and provides an output signal based on the processed signal from the effects cartridge.

16 Claims, 11 Drawing Sheets

(51) Int. Cl.
*G10H 1/053* (2006.01)
*G10H 1/00* (2006.01)
*G10H 3/18* (2006.01)

(52) U.S. Cl.
CPC ..... *G10H 3/186* (2013.01); *G10H 3/187* (2013.01); *G10H 2210/235* (2013.01); *G10H 2240/165* (2013.01)

(56) References Cited

U.S. PATENT DOCUMENTS

2013/0118340 A1* 5/2013 D'Amours ..... G10H 1/0083 84/746
2013/0327201 A1* 12/2013 Urry ..... G10H 1/06 84/626
2014/0205113 A1* 7/2014 Slipp ..... G10H 7/008 381/119
2015/0161978 A1* 6/2015 Packouz ..... G10H 1/40 84/746
2015/0371622 A1* 12/2015 Beaty ..... G10H 1/46 84/633
2016/0063976 A1* 3/2016 Wilk ..... G10H 1/055 84/626
2018/0144731 A1* 5/2018 McHale ..... G10H 1/348
2018/0330706 A1* 11/2018 Leff ..... G10H 1/348

* cited by examiner

MODULAR USER-CUSTOMIZABLE MUSIC PEDAL

CROSS-REFERENCE TO RELATED APPLICATIONS

This application claims the benefit of provisional Patent Application Ser. No. 62/503,930, filed May 9, 2017, entitled SYSTEM AND METHOD FOR AN ANALOG USER-CUSTOMIZABLE MUSIC PEDAL, and Patent Application Ser. No. 62/618,428 filed on Jan. 17, 2018, entitled SYSTEM AND METHOD FOR AN ANALOG USER-CUSTOMIZABLE MUSIC PEDAL and assigned to the assignee of the present application, and incorporated herein by reference.

BACKGROUND OF THE INVENTION

Music effects pedals may be used to modify the sound from a musical instrument or other musical component. For example, an effects pedal may be connected between an electric guitar and an amplifier in order to process the sound from the guitar. The effects pedal may be a digital effects pedal using digital electronics to process the sound, an analog effects pedal using analog circuitry for signal processing or a combination pedal that uses both digital and analog circuitry. Typically, a music effects pedal includes an input, effects circuitry and an output that are integrated together into a single unit. The input may be connected to the guitar, other instrument, or other music processing component. The output may be connected to the amplifier or other component. Thus, the signal path is from the musical instrument/component via the input, through the effects circuitry and to the amplifier/additional component via the output. The effects circuitry alters the sound input to the effects pedal. For example, the effects circuitry within the music pedal may be distortion circuitry, reverb circuitry, compression circuitry, phasers or other circuitry specific to the effects pedal. Consequently, the sound output from the amplifier may be different depending upon the effects pedal(s) used.

Although an effects pedal may be used to process sound, there is a continued drive toward further customizability of the sound by the end user. In order to produce the desired sound, the user may be forced to employ complex effects systems in lieu of the effects pedal or to combine multiple effects pedals. For example, a user may chain multiple effects pedals in series to achieve a particular sound. Accordingly, what is needed is a method and system that may improve the user's ability to customize sound. The method and system described herein address such a need.

BRIEF SUMMARY OF THE INVENTION

A user-customizable modular music effects pedal is described. The music effects pedal includes a base having an input, an output and a connector. The input receives a music signal. The connector is coupled with the input and has an electrical form factor and a physical form factor. The electrical form factor is configured to fit a corresponding electrical form factor of an effects cartridge. The physical form factor is configured to fit a corresponding physical form factor of the effects cartridge. The connector provides the music signal to the effects cartridge and receiving a processed signal from the effects cartridge. The effects cartridge includes effects electronics to provide the processed signal.

The output is coupled with the connector and provides an output signal based on the processed signal from the effects cartridge.

Using the music effects pedal, the flexibility and range of effects produced using the pedal may be improved.

DETAILED DESCRIPTION OF THE INVENTION

Figure 1:
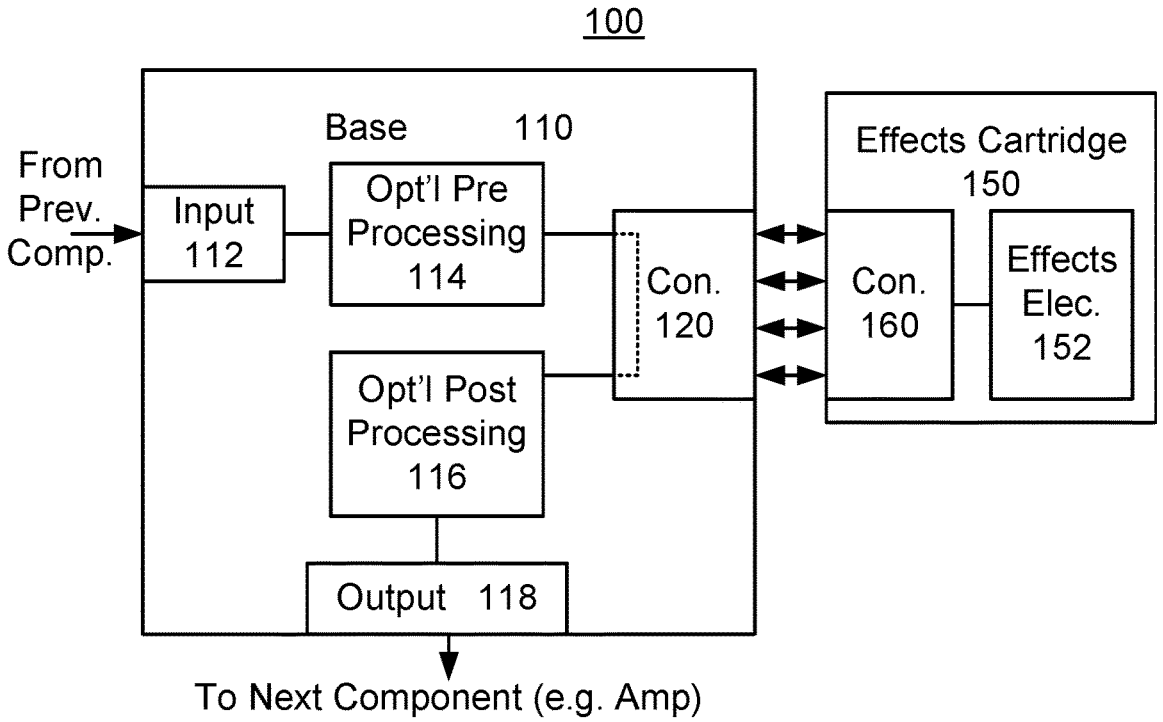
FIG. 1 is a block diagram of an exemplary embodiment of a modular music effects pedal.

The following description is presented to enable one of ordinary skill in the art to make and use the invention and is provided in the context of a patent application and its requirements. Various modifications to the exemplary embodiments and the generic principles and features described herein will be readily apparent. The exemplary embodiments are mainly described in terms of particular methods and systems provided in particular implementations. However, the methods and systems will operate effectively in other implementations. Phrases such as "exemplary embodiment", "one embodiment" and "another embodiment" may refer to the same or different embodiments as well as to multiple embodiments. The embodiments will be described with respect to systems and/or devices having certain components. However, the systems and/or devices may include more or fewer components than those shown, and variations in the arrangement and type of the components may be made without departing from the scope of the invention. The exemplary embodiments will also be described in the context of particular methods having certain steps. However, the method and system operate effectively for other methods having different and/or additional steps and steps in different orders that are not inconsistent with the exemplary embodiments. Thus, the present invention is not intended to be limited to the embodiments shown, but is to be accorded the widest scope consistent with the principles and features described herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Unless defined otherwise, all technical and scientific terms used herein have the same meaning as commonly understood by one of ordinary skill in the art to which this invention belongs. It is noted that the use of any and all examples, or exemplary terms provided herein is intended merely to better illuminate the invention and is not a limitation on the scope of the invention unless otherwise specified. Further, unless defined otherwise, all terms defined in generally used dictionaries may not be overly interpreted.

The exemplary embodiments are described in the context of particular methods, music effects pedals and circuits having certain components. One of ordinary skill in the art will readily recognize that the present invention is consistent with the use of other methods and other music pedals having other and/or additional components and/or other features not inconsistent with the present invention.

A user-customizable modular music effects pedal is described. The music effects pedal includes a base having an input, an output and a connector. The input receives a music signal. The connector is coupled with the input and has an electrical form factor and a physical form factor. The electrical form factor is configured to fit a corresponding electrical form factor of an effects connector of an effects cartridge. The physical form factor is configured to fit a corresponding physical form factor of the effects connector of the effects cartridge. The connector provides the music signal to the effects cartridge and receiving a processed signal from the effects cartridge. The effects cartridge includes the effects connector and effects electronics to process the signal. The output is coupled with the connector and provides an output signal based on the processed signal from the effects cartridge.

FIG. 1 is a block diagram of an exemplary embodiment of a modular music effects unit, or pedal, 100. For clarity, only some components of the effects pedal 100 are labeled and depicted. The effects pedal 100 may be an analog pedal. Thus, the circuitry contained therein may be purely analog circuitry. In other embodiments, some portions of the effects pedal 100 may be implemented digitally.

The effects pedal 100 includes a base 110 and an effects cartridge 150 that is connected to the base 110. The base 110 includes a housing (not separately labeled) which contains the input 112, optional pre-processing circuitry 114, optional post-processing circuitry 116, output 118 and connectors 120. The input 112 receives a music signal. For example, the input 112 may be connected directly to a musical instrument (not shown), such as a guitar, or to another musical instrument. In other applications, the input 112 may be connected to electronic component that generates the music signal or processes a signal generated by a music instrument. Thus, the input 112 is shown in FIG. 1 as receiving a music signal from a previous component. The input 112 thus includes the connectors, such as a coaxial adapter, to mate with the previous component. The input 112 may also include input buffer(s) in some embodiments.

Also shown are optional pre-processing circuitry 114 and optional post-processing circuitry 116. In some embodiments, the optional circuitry 114 and 116 may simply include input and output buffers, respectively. In other embodiments, additional signal processing is performed by the circuitry 114 and 116. For example, if the effects cartridge 150 is a distortion cartridge, discussed below, then the optional post processing circuitry 116 may include circuitry that adjusts tone. The circuitry 114 and/or 116 may also include a mechanism for user control over the effects pedal 100. For example, a dial that controls volume/power supplied or a switch that can bypass some portion of the electronic 114, 116 and/or 120 may be incorporated. However, in other embodiments, one or both of the circuitry 114 and 116 may be omitted. Although not shown, the base 110 may include a power supply. In other embodiments, power may be externally supplied to the base 110 and, therefore, to the effects pedal 100.

The output 118 provides the output signal from the effects pedal 100. For example, the output may be connected directly to an audio amplifier to play the sound produced. In other embodiments, the output 118 may be connected to another musical component that performs additional processing of the signal. Thus, the output 118 is shown as providing an output signal to a next component. The output 118 includes the connectors, such as a coaxial adapter, to the next component. The output 118 may also include output buffer(s) in some embodiments.

The base 110 also includes connector 120. The connector 120 has a form factor that is configured to fit the corresponding effects cartridge connector 160, discussed below. For example, the connector 120 may have a particular electrical and physical form factor. In some embodiments, this form factor may include a female socket (e.g. physical form factor) having a number of electrical pads in a particular configuration (electrical form factor). Thus, the effects cartridge 150 may be physically and electrically connected to the base 110 or physically and electrically separated from the base 110.

As shown by the arrows in FIG. 1, the connector 120 provides a signal to and receives a signal from the effects cartridge 150. In some embodiments, the connector 120 may provide power to the effects cartridge 150. In an alternate embodiment, the effects cartridge 150 may receive power from another source (not shown). In some embodiments, the connector 120 is configured such that the connector 120 is bypassed if the effects cartridge 150 is not coupled with the connector 120. This is indicated by the dashed line in FIG. 1, which directly electrically connects processing circuitry blocks 114 and 116. In such an embodiment, the effects pedal 100 still provides signal processing performed by optional circuitry 114 and/or 116, if present, even if the effects cartridge 150 is disconnected from the effects pedal 100. In an alternate embodiment, the effects pedal 100 may be nonfunctional when the effects cartridge 150 is not connected to the base 110. Further, although only one connector 120 is shown, in another embodiment, the base 110 may include additional connector(s) for additional effects cartridges (not shown).

The effects cartridge 150 includes a connector 160 and effects electronics 152. The effects electronics 152 are responsible for processing the music signal provided by the connector 120. For example, the effects electronics 152 may provide distortion, tone, phaser, reverb, compression, filtering, modulation, and/or other musical effects. Thus, the effects cartridge 150 may be a distortion cartridge, a tone cartridge, a phaser cartridge, a reverb cartridge, a compressor cartridge, a filtering cartridge, a modulation cartridge or some combination thereof. In some embodiments, the circuitry for the effects electronics 152 is purely analog. In another embodiment, the effects electronics 152 may be a mix of analog and digital circuitry. Further, the effects electronics 152 may provide some level of user customizability. For example, the effects electronics 152 may include one or more switches (not shown) that selectively bypasses portion(s) of the effects electronics 152. The effects electronics 152 may also allow for finer control, for example via dial(s) that control the fraction of music signal or power provided to a portion of the circuitry.

The connector 160 of the effects cartridge 150 has an effects cartridge electrical form factor and an effects cartridge physical form factor. The effects cartridge electrical form factor is configured to fit the electrical form factor of the connector 120. Similarly, the effects cartridge physical form factor is configured to fit the physical form factor of the connector 120. In the example discussed above, the connector 120 is a female socket (physical form factor) having a particular configuration of electrical pads (electrical form factor). In such an embodiment, the connector 160 is a matching male socket (effects cartridge physical form factor) having a configuration of electrical pins or pads (effects cartridge electrical form factor) that matches the female socket and electrical pads of the connector 120. Thus, the connectors 120 and 160 are configured to have matching form factors, to fit together physically, and to exchange electrical signals. Once fit together, the connectors 120 and 160 may be retained together until the user releases them. For example, a mechanical, electrical, magnetic and/or other locking mechanism may be part of the configuration of the connectors 120 and/or 160. The effects cartridge 150 may thus be plugged into the base 110 to receive the signal from the base and perform signal processing using the effects electronics 152 and provide the processed signal back to the connector 120.

Although a single connector 120 for the base and a single connector 160 for the effects cartridge 150 are shown, in other embodiments, multiple connectors might be used for a single effects cartridge 150. Stated differently, the functionality of each of the connectors 120 and 160 may be split into multiple connectors. For example, the music effects pedal 100 might have one connector on the base 110 to provide the signal to the effects cartridge 150. A connector on the effects cartridge 150 having a matching form factor is coupled to base 110 and receives the signal. The effects cartridge 150 might have another connector to output the processed signal. A connector having a matching form factor on the base 110 receives the processed signal. The form factors of the connector(s) on the base 110 are still configured to match the connector(s) on the effects cartridge 150.

In operation, a music signal is provided to the input 112 of the base 110. Optional pre-processing circuitry 114 may perform buffering, timing delays and/or other signal processing. The signal is provided to the effects cartridge 150 via the mated connectors 120 and 160. The signal path includes the effects electronics 152, which process the signal to provide the desired effects. This processed signal is provided back to the base via connectors 120 and 160. The processed signal may undergo further buffering, timing adjustment and/or other processing by optional post-processing circuitry 116. The processed signal is output to the next component via the output 118.

The effects pedal 100 may allow a user to obtain a greater variety of music effects than a conventional pedal including relatively static circuitry. The user may use different effects cartridges 150 with the base 110 to customize the effects pedal 100. In some embodiments, the user may further customize the same type of effect. For example, the user may obtain different types and/or amounts of distortion by using different distortion effects cartridges 150 for which the effects electronics 152 differ. In some embodiments, different types of effects cartridges 150 may be used with the base 110. In such embodiments, the user may obtain different effects from the music pedal 100. For example, the user may switch a distortion effects cartridge 150 for a reverb effects cartridge 150 or a phaser cartridge 150 while utilizing the same base 110. Thus, the variety of effects provided by the effects pedal 100 may be enhanced. Because only the effects cartridge 150 may be switched to change the effect, the cost of obtaining a greater variety of effects may also be reduced. The base 110 and effects cartridge 150 may also be manufactured such that sound quality is substantially maintained. The effects pedal 100 may allow users to easily, quickly and inexpensively obtain a unique and high-quality sound.

Figure 2A:
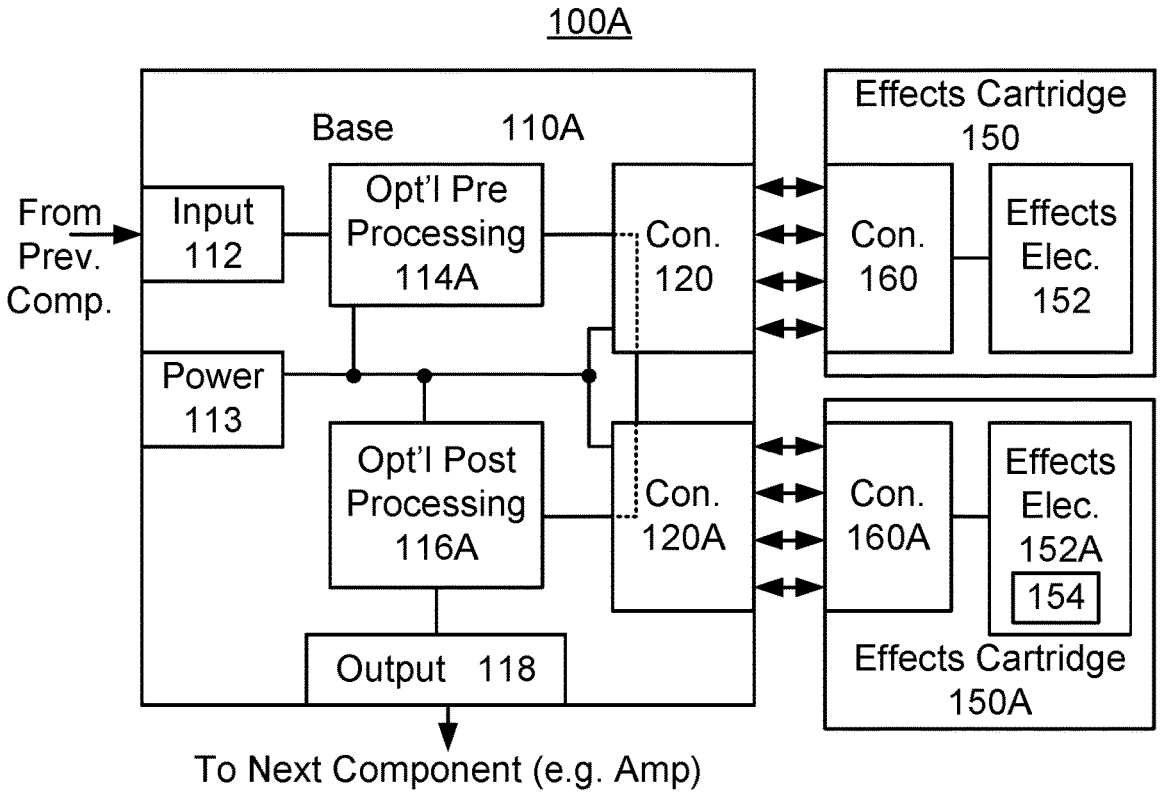
FIGS. 2A-2C are block diagrams of other exemplary embodiments of a modular music effects pedal.
Figure 2B:
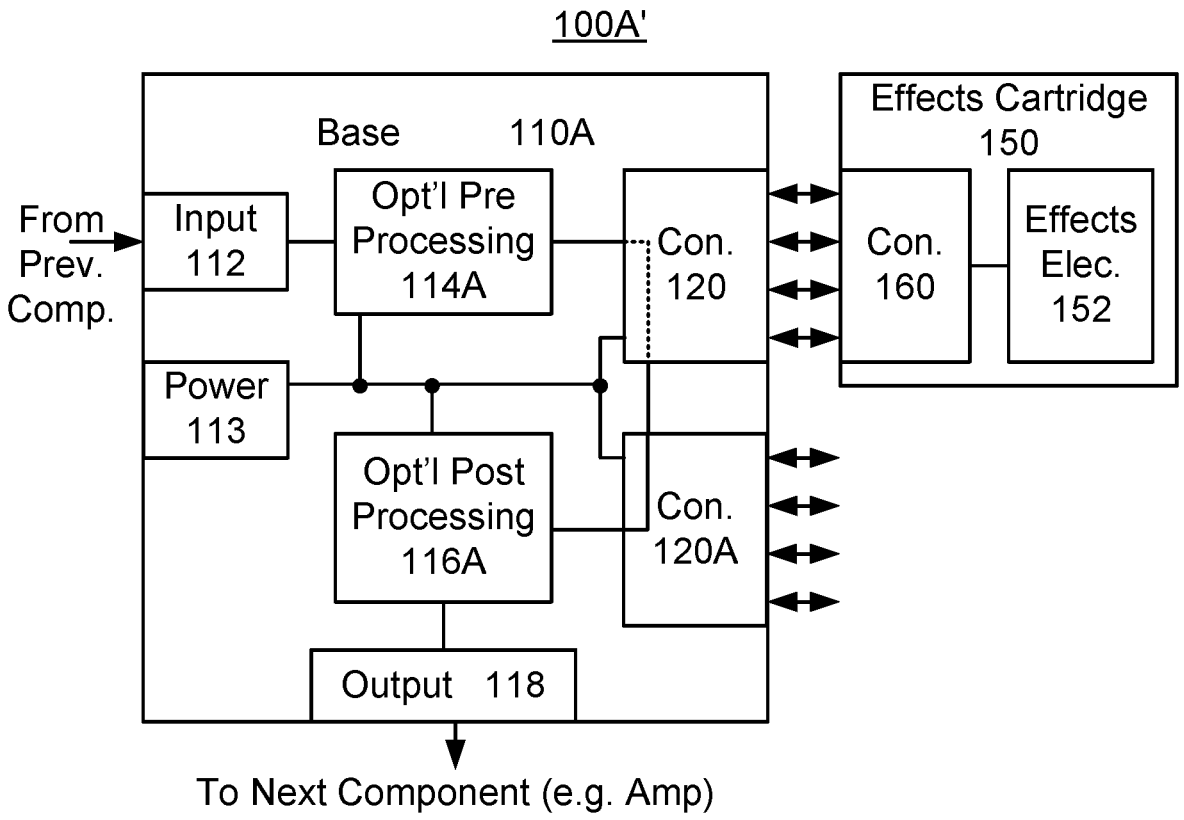
Figure 2C:
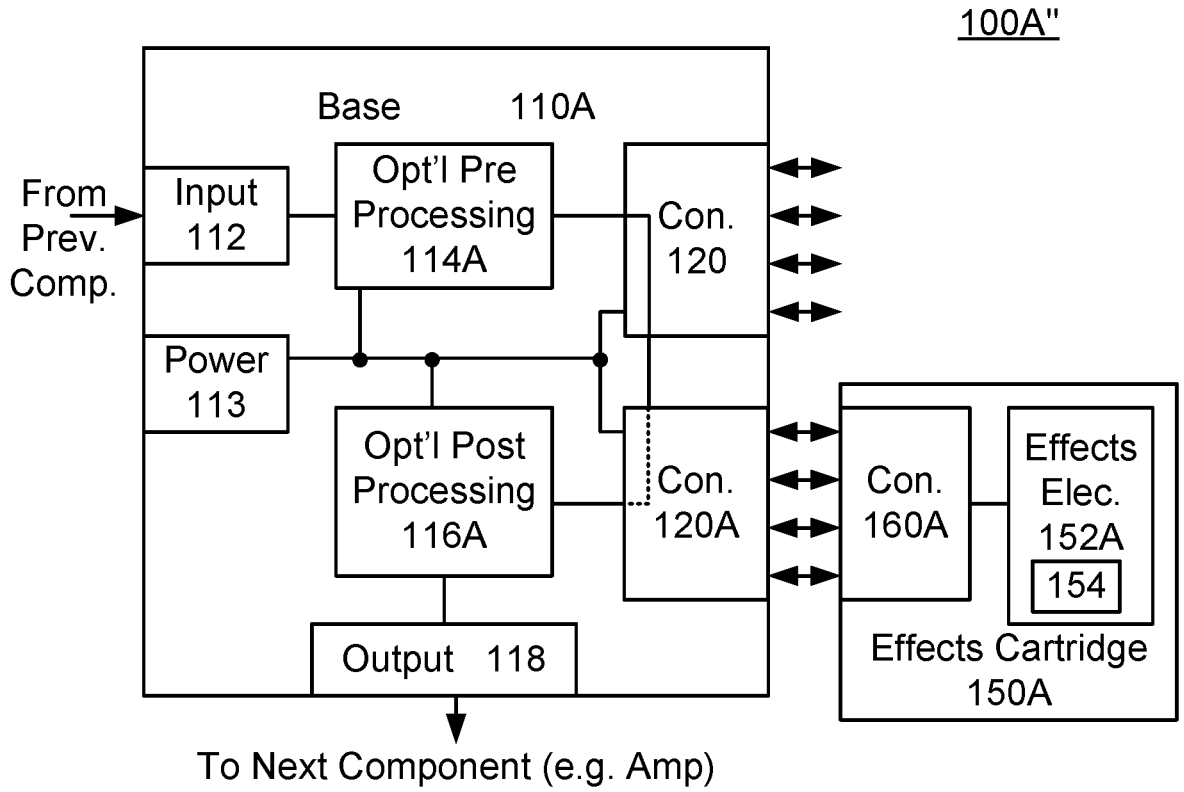

FIGS. 2A-2C are block diagrams of other exemplary embodiments of modular music effects pedals 100A, 100A' and 100A", respectively. For clarity, only some components of the effects pedals 100A, 100A' and 100A" are labeled and included. The effects pedals 100A, 100A' and 100A" may be analog pedals. Thus, the circuitry contained therein may be purely analog circuitry. In other embodiments, some portions of one or more of the effects pedal(s) 100A, 100A' and 100A" may be digitally implemented.

The effects pedals 100A, 100A' and 100A" are analogous to the effects pedal 100. Consequently, analogous components have similar labels. The effects pedal 100A thus includes a base 110A and an effects cartridge 150 that are analogous to the base 110 and effects cartridge 150 of the effects pedal 100. The base 110 includes an input 112, optional pre-processing circuitry 114A, optional post-processing circuitry 116A, output 118 and connector 120 that are analogous to input 112, optional pre-processing circuitry 114, optional post-processing circuitry 116, output 118 and connector 120 depicted in FIG. 1. The structure and function of these components 112, 114A, 116A, 118 and 120 are thus analogous to that described above. Although optional pre-processing circuitry 114A is shown as occurring earlier in the signal path than the connector 120/effects electronics 152, in another embodiment, optional pre-processing circuitry 114A could occur between connectors 120 and 120A. Similarly, optional post-processing circuitry 116A is shown as occurring later in the signal path than the connector 120A/effects electronics 152A. In another embodiment, optional post-processing circuitry 116A could be placed between the connectors 120 and 120A.

The base 110A also includes a power supply 113 and connector 120A. The power supply 113 is explicitly shown as supplying power to the circuitry 112, 114A, 116A, 118A, 120 and 120A within the base 110A. In addition, the power supply 113 provides power to the effects cartridges 150 and 150A via connectors 120 and 120A, respectively. In another embodiment, the cartridges 150 and/or 150A may obtain power in another manner.

The connector 120A is analogous to the connector 120 in that it has an electrical form factor and a physical form factor configured to fit the corresponding effects cartridge 150A. In some embodiments, the form factors of the connectors 120 and 120A are the same. In such embodiments, the same cartridges 150 and/or 150A may be connected with the connectors 120 and 120A. However, in other embodiments, the connectors 120 and 120A may have different form factors. In such embodiments, the cartridges 150 and 150A plugged into the connectors 120 and 120A, respectively, also have different form factors. In the embodiment shown, the connector 120A may be bypassed if no cartridge is plugged into the connector 120A. This is indicated by the dashed line through connector 120A.

The effects cartridge 150A is analogous to the effects cartridge 150. Thus, the effects cartridge 150A includes effects electronics 152A and connector 160A that are analogous to the effects electronics 152 and the connector 160, respectively. The effects electronics 152A can, but need not, provide circuitry for the same effects as effects electronics 152. For example, both effects cartridges 150 and 150A may provide distortion. The distortion provided by each cartridge 150 and 150A may differ or may be the same. Alternatively, the cartridges 150 and 150A may provide different effects. For example, the effects electronics 152 may include clipping circuitry to provide distortion, while the effects electronics 152A may adjust tone. Stated differently, the effects cartridge 150 may be a distortion cartridge, while the effects cartridge 150A may be a tone cartridge. Other cartridges having other or additional effects may be used. For example, the cartridges 150 and 150A may each be a distortion cartridge, a tone cartridge, a phaser cartridge, a reverb cartridge, a compressor cartridge, a filtering cartridge, a modulation cartridge, some combination thereof and/or a different cartridge.

The connector 160A of the effects cartridge 150A has a form factor that fits the form factor of the connector 120A. Thus, the form factor of the connector 160A may be the same as or different from the form factor of the connector 160. The effects electronics 152A are also shown as including a user-customizable feature 154. For example, the feature 154 may be a switch that selectively connects (or bypasses) portions of the effects electronics 152A. Thus, the switch 154 may have a first position that connecting certain circuit components in the circuitry 152A to the signal path within the effects cartridge 150A. A second position of the switch 154 may isolate the circuit components from the signal path. Alternatively, the first and second positions of such a switch may selectively couple a first component and a second component, respectively. The feature 154 may be a dial, potentiometer, or analogous mechanism that allows finer control over characteristics such as a signal amplitude, signal split and/or power. Different and/or additional control over the effects electronics 152A may be user-customizable feature 154. Thus, a variable effect may also be obtained. Although one feature 154 is shown in one cartridge 150A, multiple features in either or both cartridges 150 and 150A may be present.

The effects pedal 100A provides multiple effects. A music signal is provided to the input 112 of the base 110. The signal path includes optional pre-processing circuitry 114A (if present), connectors 120 and 160 and effects electronics 152. Thus, the effects cartridge 150 outputs a processed signal having the effects provided by effects electronics 152. The processed signal is then provided to connector 120A. The processed signal is provided to effects electronics 152A via connectors 120A and 160A. The effects electronics 152A perform additional signal processing and may provide an additional effect. The (twice) processed signal is provided back to the base 110A via connectors 160A and 120A. The processed signal may undergo further processing by optional post-processing circuitry 116A (if present). The processed signal is output to the next component via the output 118.

FIG. 2B depicts the effects pedal 100A'. The effects pedal 100A' is analogous to the effect pedal 100A. The effects pedal 100A' thus includes a base 110A and an effects cartridge 150 that are analogous to the base 110A and effects cartridge 150 of the effects pedal 100A. However, the effects cartridge 150A has been omitted in the effects pedal 100A'. As can be seen by the solid line through connector 120A the connector 120A is bypassed. Stated differently, the processed signal from the effects cartridge 150 may be provided directly to the post-processing circuitry 116A, if present, or directly to the output 118.

For the effects pedal 100A', the signal path includes optional pre-processing circuitry 114A (if present), connectors 120 and 160 and effects electronics 152. Thus, the effects cartridge 150 outputs a processed signal having the effects provided by effects electronics 152. The connector 120A is bypassed because no effects cartridge is connected. The processed signal may undergo further processing by optional post-processing circuitry 116A (if present). The processed signal is output to the next component via the output 118.

FIG. 2C depicts the effects pedal 100A". The effects pedal 100A" is analogous to the effect pedal 100A. The effects pedal 100A" thus includes a base 110A and an effects cartridge 150A that are analogous to the base 110A and effects cartridge 150A of the effects pedal 100A. However, the effects cartridge 150 has been omitted in the effects pedal 100A". As can be seen by the solid line through connector 120, the connector 120 is bypassed. Stated differently, the signal from the optional pre-processing circuitry 114A, if present, or from the input 112 may be provided directly to the connector 120A and thus to the effects cartridge 150A.

In operation, the music effects pedal 100A" provides the effects from the cartridge 152A. The music signal is provided to the input 112 of the base 110. The signal path includes optional pre-processing circuitry 114A (if present). The connector 120 is bypassed because no effects cartridge is connected. The signal is transmitted to connector 120A. The signal is provided to effects electronics 152A via connectors 120A and 160A. The effects electronics 152A perform signal processing and may provide an effect. The processed signal is provided back to the base 110A via connectors 160A and 120A. The processed signal may undergo further processing by optional post-processing circuitry 116A (if present). The processed signal is output to the next component via the output 118.

Thus, the effects pedals 100A, 100A' and 100A" allows for zero through two effects cartridges 150/150A to be used with the base 110A. In alternate embodiments, only the first connector 120 may be used alone, only the second connector 120A may be used alone, or both connectors 120 and 120A must be used together for the effects pedal 100A/100A'/100A" to function.

The effects pedal 100A shares the benefits of the effects pedal 100. The effects pedals 100A/100A'/100A" may provide an even greater variety of music effects because of the possibility of multiple combinations of effects cartridges 150, 150A or 150 and 150A. In another embodiment, three or more connectors may be incorporated into the base 110A. Thus, further modular customization may be achieved by switching the effects cartridges 150/150A connected to the base 110A. As discussed above, the same or different cartridges may be used for the cartridges 150 and 150A. Thus, user may further customize the same type of effect or provide multiple different effects together. Because of the presence of user-customizable feature 154 in the effects electronics 152A, another level of modification to the effects provided is possible. Stated differently, a hierarchy of customization may be achieved. A base, or gross level of customization may be obtained through the use of different effects cartridges 150/150A. A finer level of control may be provided by the feature 154. Thus, the variety of effects provided by the effects pedal 100A/100A/100A" may be enhanced. Because the effects cartridges 150 and 150A may be used with the same base 110A, the cost of obtaining a greater variety of effects may also be reduced. The base 110A and effects cartridges 150 and 150A may also be manufactured such that sound quality is substantially maintained. The effects pedals 100A, 100A' and 100A" may allow users to easily, quickly and inexpensively obtain a high quality, unique sound.

Figure 3:
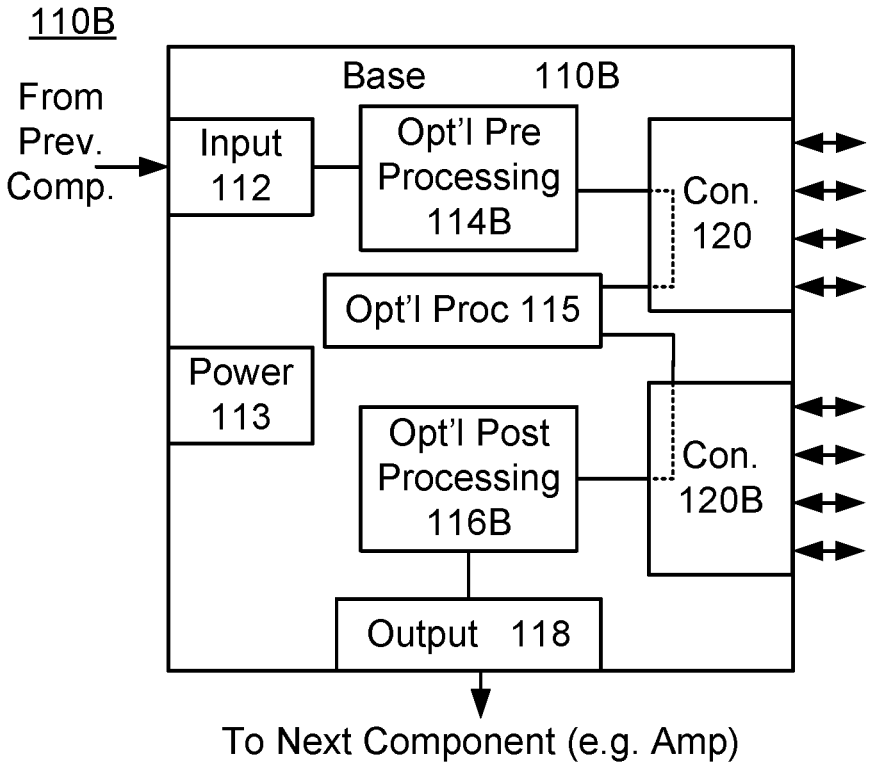
FIG. 3 is a block diagram of an exemplary embodiment of a base unit of a modular music effects pedal.

FIG. 3 is a block diagram of an exemplary embodiment of a base unit 110B of a modular music effects pedal. For clarity, only some components of the base 110B are labeled and included. The base 110B may be used in the effects pedals 100, 100A, 100A' and/or 100A". Thus, the circuitry contained therein may be purely analog circuitry. Alternatively, some or all of the circuitry may be digitally implemented.

Because the base 110B is analogous to the bases 110 and 110A, analogous components have similar labels. The base 110B includes an input 112, optional pre-processing circuitry 114B, optional post-processing circuitry 116B, output 118 and connectors 120 and 120A that are analogous to input 112, optional pre-processing circuitry 114/114A, optional post-processing circuitry 116/116A, output 118 and connectors 120 and 120A of effects pedals 100, 100A, 100A' and/or 100A". The structure and function of these components 112, 114A, 116A, 118 and 120 are thus analogous to that described above.

In addition, the base 110B includes optional circuitry 115 between the connectors 120 and 120A. Thus, the processed circuit from an effects cartridge (e.g. effects cartridge 150) plugged into the connector 120 may be further processed before being provided to another effects cartridge (e.g. effects cartridge 150A) plugged into the connector 120B. Thus, additional signal processing may be performed. As discussed above, one or more of the circuitry 114B, 115 and 116B may be omitted.

An effects pedal incorporating the base 110B provides similar benefits to the music effects pedals 100, 100A, 100A' and/or 100A". Such an effects pedal may allow users to easily, quickly and inexpensively obtain a high quality customized sound.

Figure 4:
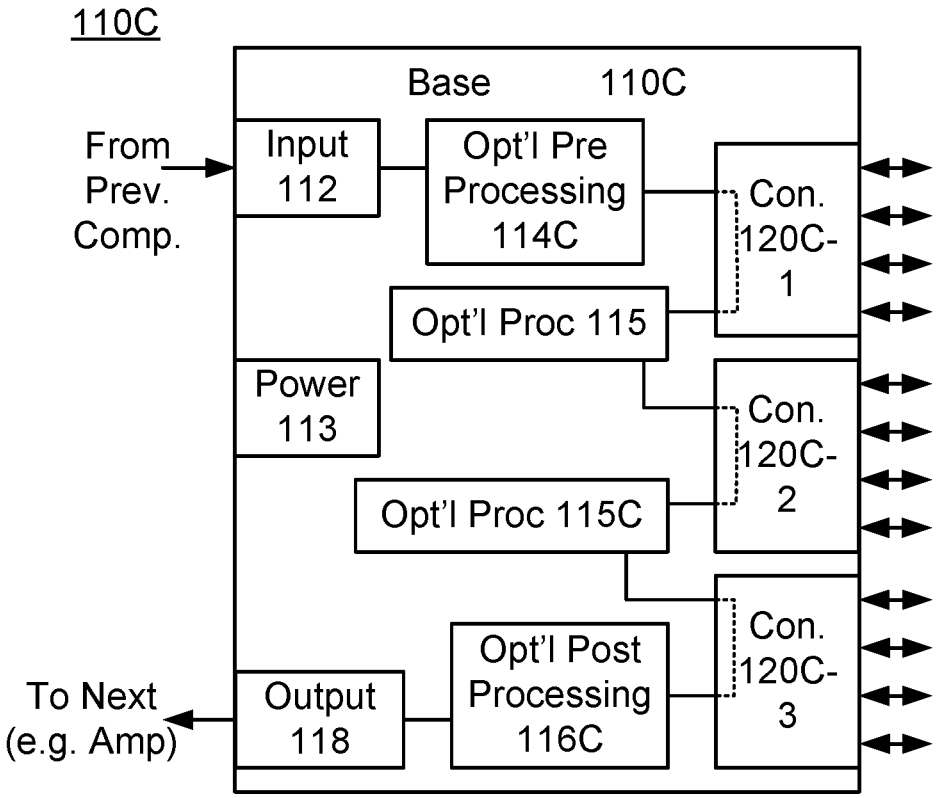
FIG. 4 is a block diagram of another exemplary embodiment of a base unit of a modular music effects pedal.

FIG. 4 is a block diagram of an exemplary embodiment of a base unit 110C of a modular music effects pedal. For clarity, only some components of the base 110C are labeled and included. The base 110C may be used in the effects pedals such as the effects pedals 100, 100A, 100A' and/or 100A". Thus, the circuitry contained therein may be purely analog circuitry. Alternatively, some or all of the circuitry may be digitally implemented.

The base 110C is analogous to the bases 110, 110A and 110B. Therefore, analogous components have similar labels. The base 110C includes an input 112, optional pre-processing circuitry 114C, optional circuitry 115, optional post-processing circuitry 116C, output 118 and connectors 120C-1 and 120C-2 that are analogous to input 112, optional pre-processing circuitry 114/114A/114B, optional circuitry 115, optional post-processing circuitry 116/116A/116B, output 118 and connectors 120 and 120A/120B of effects pedals 100, 100A, 100A' and/or 100A". The structure and function of these components 112, 114C, 116C and 118 are thus analogous to that described above.

In addition, the base 110C includes a third connector 120C-3 and optional circuitry 115C between the connectors 120C-2 and 120C-3. Thus, a third effects cartridge (not shown) that may provide further customizability may be used with the base 110C. In addition, the processed circuit from an effects cartridge plugged into the connector 120C-2 may be further processed before being provided to another effects cartridge plugged into the connector 120C-3. Thus, additional signal processing may be performed. As discussed above, one or more of the circuitry 114C, 115, 115C and 116C may be omitted. In addition, a larger number of connectors such as the connectors 120C-1 through 120C-3 might be used. However, one of ordinary skill in the art will understand that although additional connectors and additional effects cartridges provide further opportunities for user-customization, this may adversely affect ease of use of the effects pedal containing the base 110C and/or may negatively impact the profile of the pedal. Thus, in some embodiments, the number of connectors is limited to three 120C-1, 120C-2 and 120C-3. In some such embodiments, the number of connectors is limited to two 120 and 120A/120B. Although possibly undesirable because the customization is more limited, in some embodiments only a single connector 120 is incorporated into the base 110.

An effects pedal incorporating the base 110C provides similar benefits to the music effects pedals 100, 100A, 100A' and/or 100A". Such an effects pedal may allow users to easily, quickly and inexpensively obtain a high quality customized sound.

Figure 5:
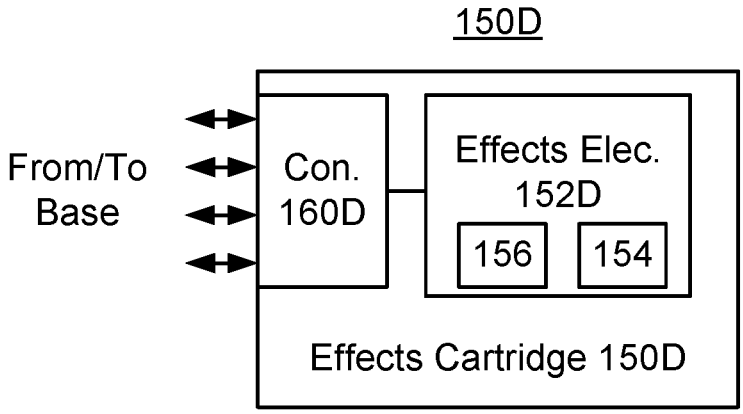
FIG. 5 is a block diagram of an exemplary embodiment of an effects cartridge of a modular music effects pedal.

FIG. 5 is a block diagram of another exemplary embodiment of an effects cartridge 150D for a modular music effects pedal. For clarity, only some components of the effects cartridge 150D are labeled and included. The effects cartridge 150D may be used in the effects pedals such as the effects pedals 100, 100A, 100A' and/or 100A" and with bases 110, 110A, 110B and/or 110C. The circuitry used in the effects electronics 152D may be purely analog circuitry or may be a mix of analog and digital.

The effects cartridge 150D is analogous to the effects cartridges 150 and/or 150A. Therefore, analogous components have similar labels. The effects cartridge 150D includes connector 160D and effects circuitry 152D that are analogous to connectors 160 and 160A and effects circuitry 152 and 152A. The effects circuitry includes user-customizable feature 154 analogous to the feature 154 described above. In addition, the effects circuitry 152D includes a second customizable feature 156. For example, the customizable features 154 and 156 may include switches, potentiometers, dials and/or other means for tuning the effects circuitry 152D. Although two user-customizable features 154 and 156 are shown in the effects cartridge 150D, another number may be present. In some embodiments, three or more features may be included on a single effects cartridge. For example, three potentiometers and multiple switches might be used to allow fine control over the effects provided by the effects cartridge 150D and/or analogous effects cartridges. Thus, the effects circuitry 152D may be further tailored to produce the sound desired.

An effects pedal incorporating the effects cartridge 150D provides similar benefits to the music effects pedals 100, 100A, 100A' and/or 100A". Such an effects pedal may allow users to easily, quickly and inexpensively obtain a high quality customized sound. This sound may be even further customized through the use of additional features 154 and 156.

Figure 6:
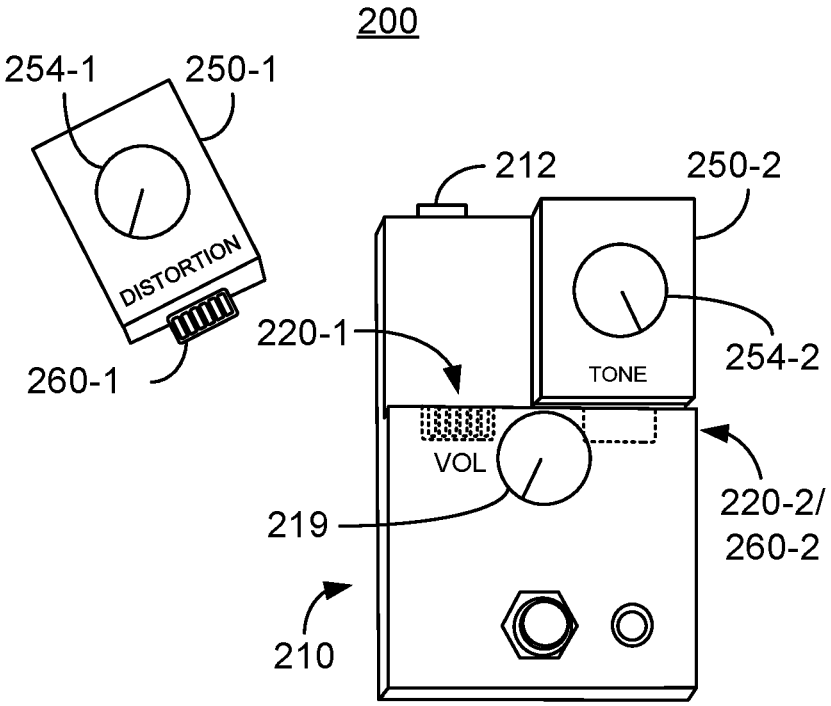
FIG. 6 is a perspective view of another exemplary embodiment of a modular music effects pedal.

FIG. 6 is a perspective view of another exemplary embodiment of a modular music effects pedal 200. FIGS. 7-14 are schematics of exemplary embodiments of electronics 270, 280-1, 280-2, 280-3, 290-1, 290-2, 290-3 and 295 usable in the effects pedal 200. For clarity, only some components of the effects pedal 200 are labeled and included. The effects pedal 200 may be an analog pedal. Thus, the circuitry 270, 280-1, 280-2, 280-3, 290-1, 290-2, 290-3 and 295 may be purely analog circuitry. In other embodiments, some portions of the effects pedal 200 may be digitally implemented. In the embodiment shown, circuits 270, 280-1, 280-2, 280-3, 290-1, 290-2 and 290-3 are formed on circuit boards. In other embodiments circuitry different from the electronics 270, 280-1, 280-2, 280-3, 290-1, 290-2, 290-3 and 295 may be used.

The music effects pedal 200 is analogous to the effects pedals 100, 100A, 100A' and 100A". The effects pedal 200 includes a base 210 and effects cartridges 250-1 and 250-2. The effects cartridge 250-1 is a distortion cartridge, while the effects cartridge 250-2 is a tone cartridge. Thus, effects pedal 200 is a distortion pedal that may be considered a particular application of the effects pedals 100, 100A, 100A' and 100A". In FIG. 6, the distortion cartridge 250-1 has not yet been plugged into the connector 220-1. In some embodiments, the connector 220-1 is bypassed until the distortion cartridge 250-1 has been connected. The housing of the base 210 and cartridges 250-1 and 250-2 shown in FIG. 11 may be made of sheet metal. Such a material allows for simpler construction of the components 210, 250-1 and 250-2. However, in an alternate embodiment, other materials may be used. Further, although shown as rectangular in FIG. 6, in other embodiments, the base 210 and/or cartridges 250-1 and 250-2 may have another shape.

Figure 7:
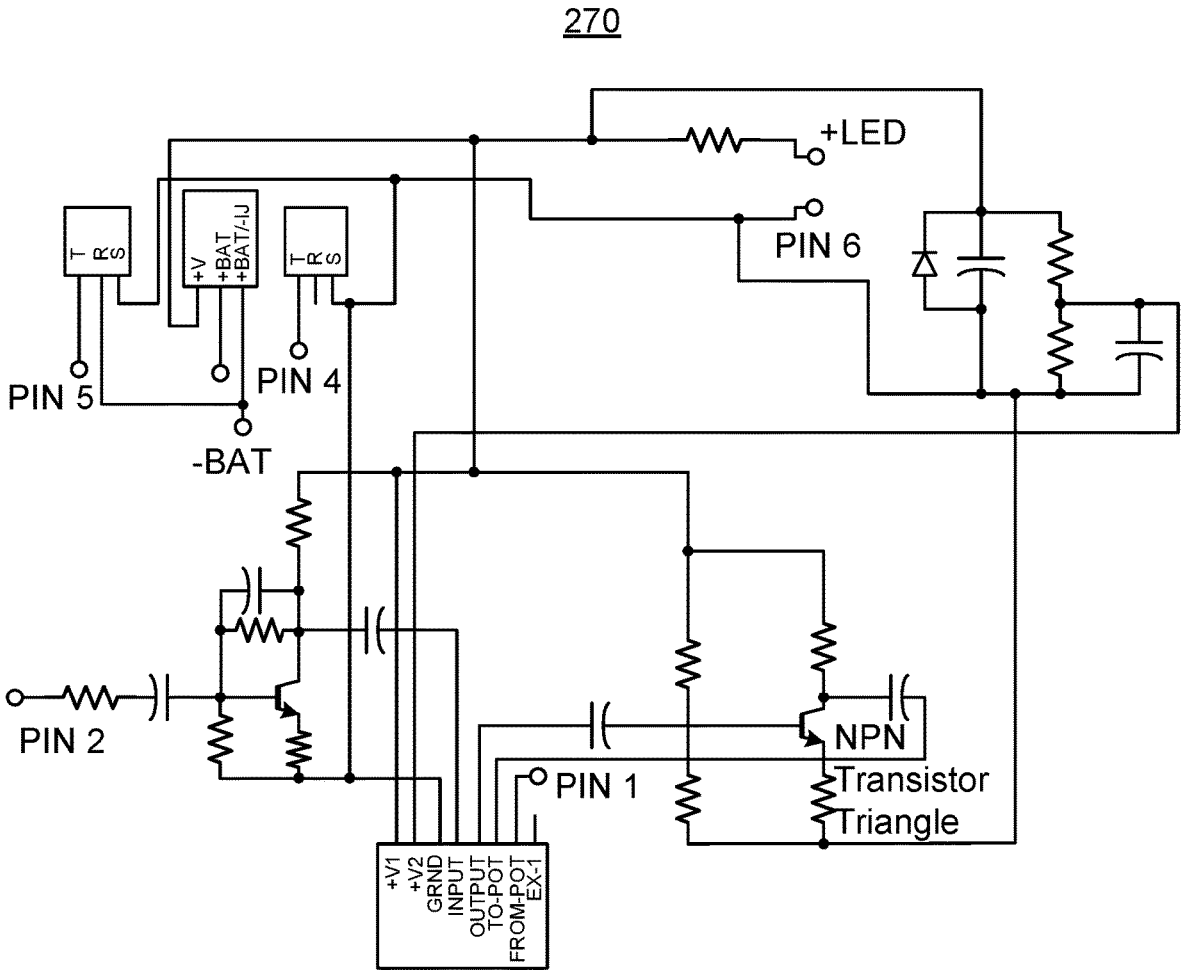
FIG. 7 is a schematic of an exemplary embodiment of a base unit for a modular music effects pedal.

The base 210 is analogous to the base 110, 110A, 110B and 110C. The base 210 includes input 212 and connector 220-1 analogous to input 112, connector 120, 120A, 120B, 120C-1, 120C-2, 120C-3. The connector 220-1 is shown as a dashed line because it is internal to the housing (e.g. a female socket). The base 210 also include a connector 220-2 that is analogous to the connector 220-1 and that is connected to the connector 260-2 of the tone cartridge 250-2. Further, an output (not shown) and electronics internal to the housing shown that are analogous to output 118 and to one or more of the components 114A/114B/114C, 115/115C, 116/116A/116B may be included. FIG. 7 depicts an exemplary embodiment of the electronics 270 for the base 210.

Figure 8:
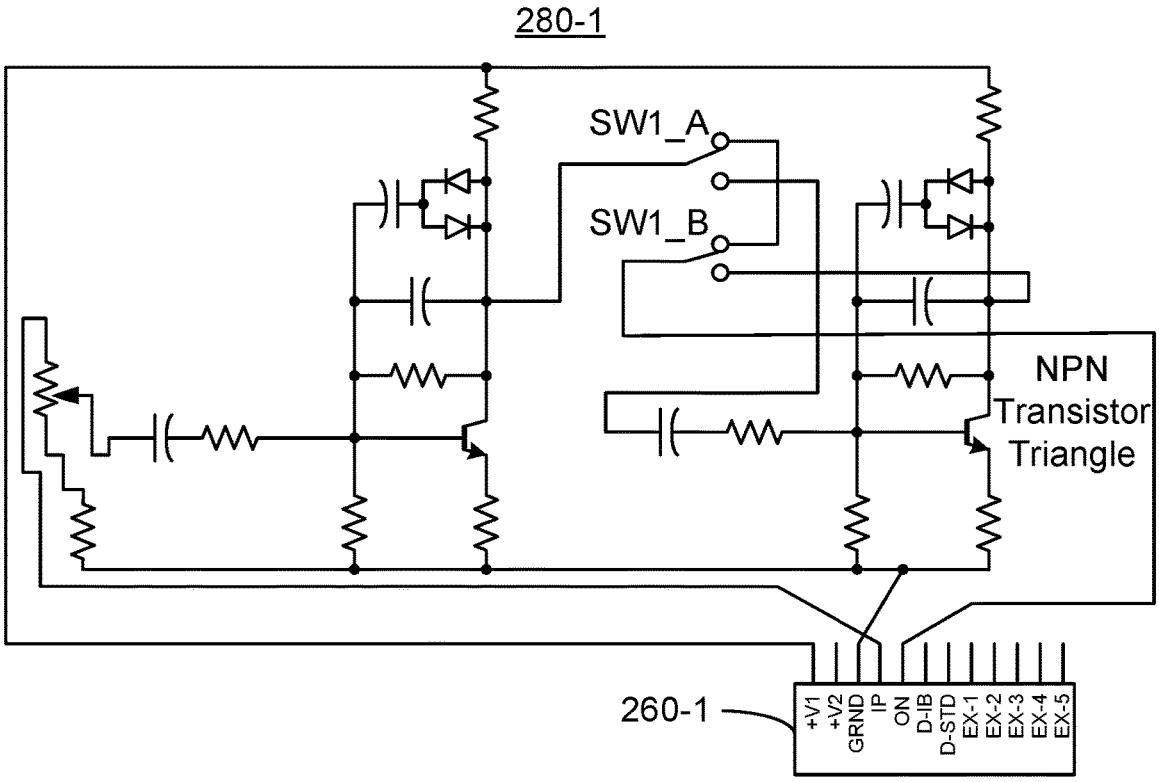
FIG. 8 is a schematic of an exemplary embodiment of an effects cartridge that provides distortion for a modular music effects pedal.
Figure 9:
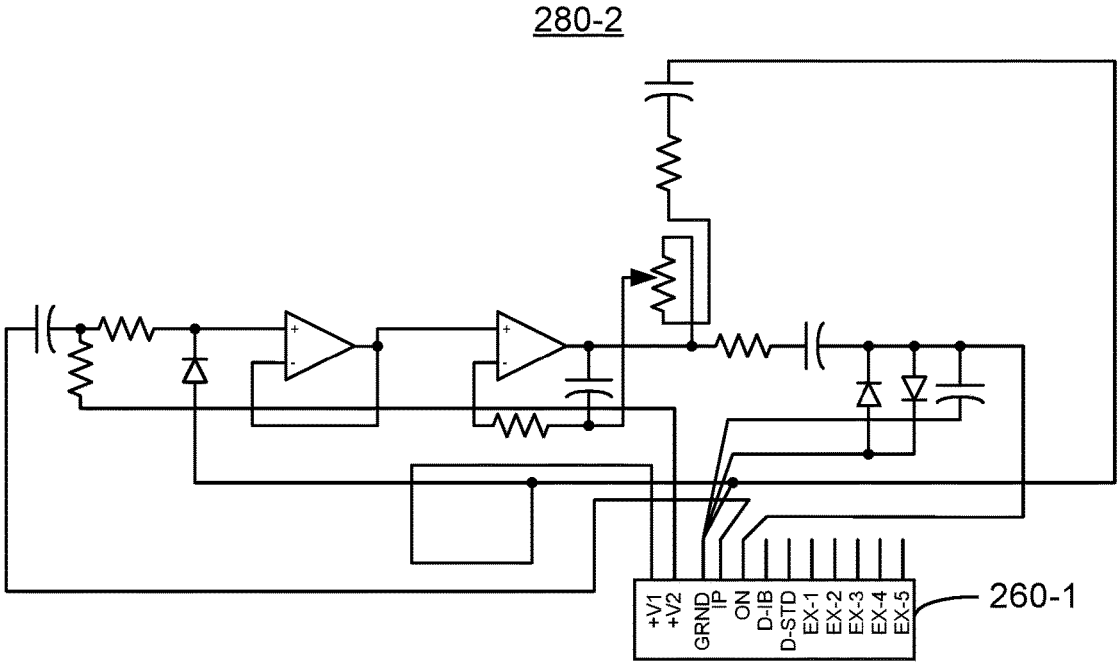
FIG. 9 is a schematic of another exemplary embodiment of an effects cartridge that provides distortion for a modular music effects pedal.
Figure 10:
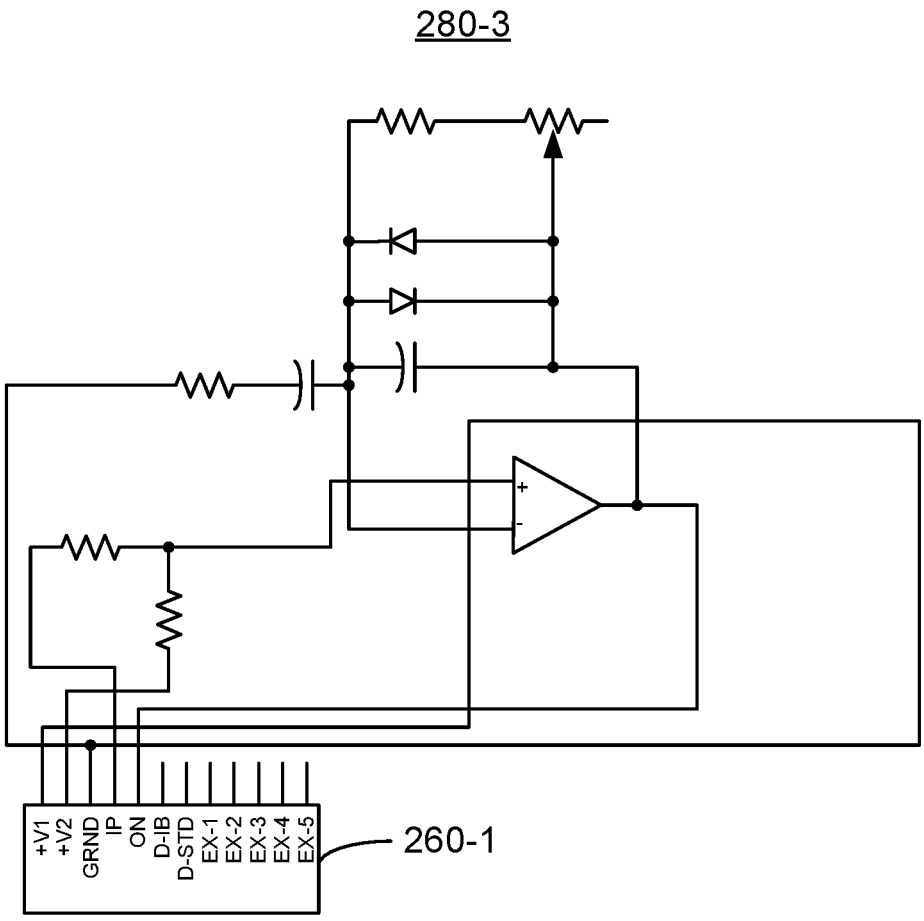
FIG. 10 is a schematic of another exemplary embodiment of an effects cartridge that provides distortion for a modular music effects pedal.

The distortion cartridge 250-1 includes a connector 260-1 having a form factor configured to fit the connector 220-1. Also shown is a user-customizable feature 254-1. FIGS. 8, 9 and 10 depict schematics of electronics 280-1, 280-2 and 280-3, respectively, for implementations of the distortion cartridge 250-1. Thus, three different distortion cartridges 250-1 might be coupled with the base 210. Consequently, the effects pedal 200 may be capable of providing three very different types of distortion.

Figure 11:
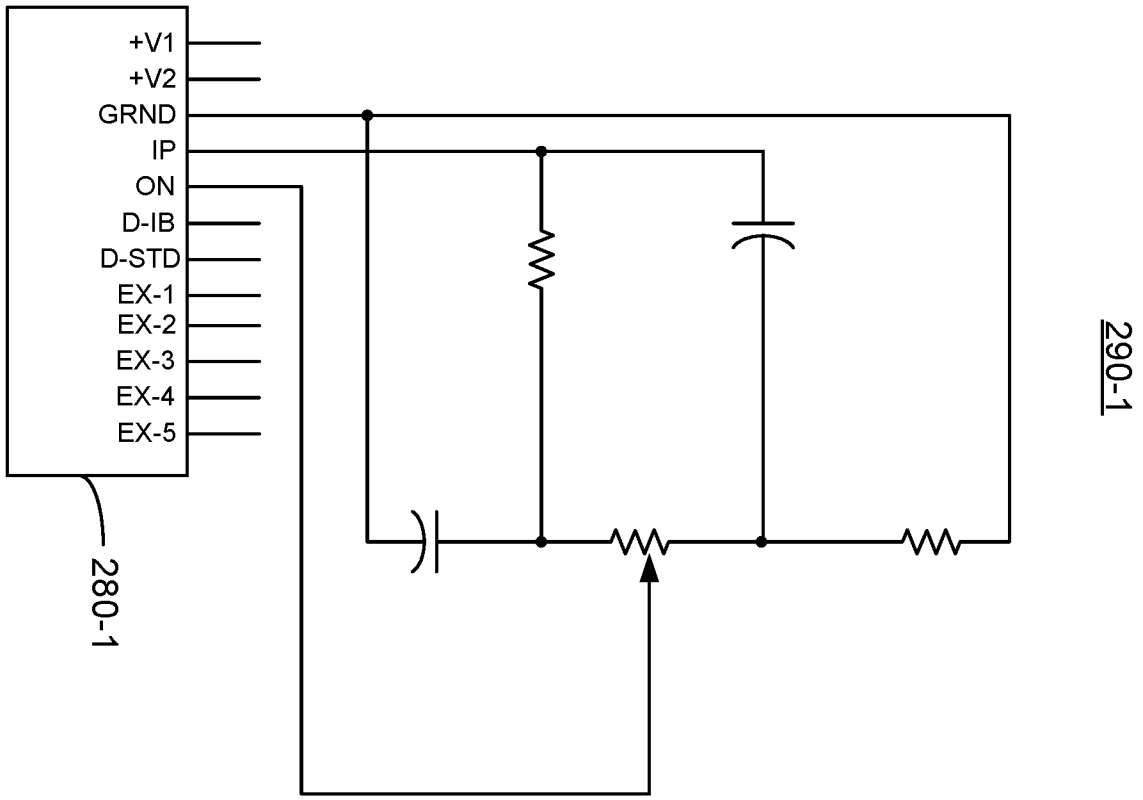
FIG. 11 is a schematic of an exemplary embodiment of an effects cartridge that provides tone adjustment for a modular music effects pedal.
Figure 12:
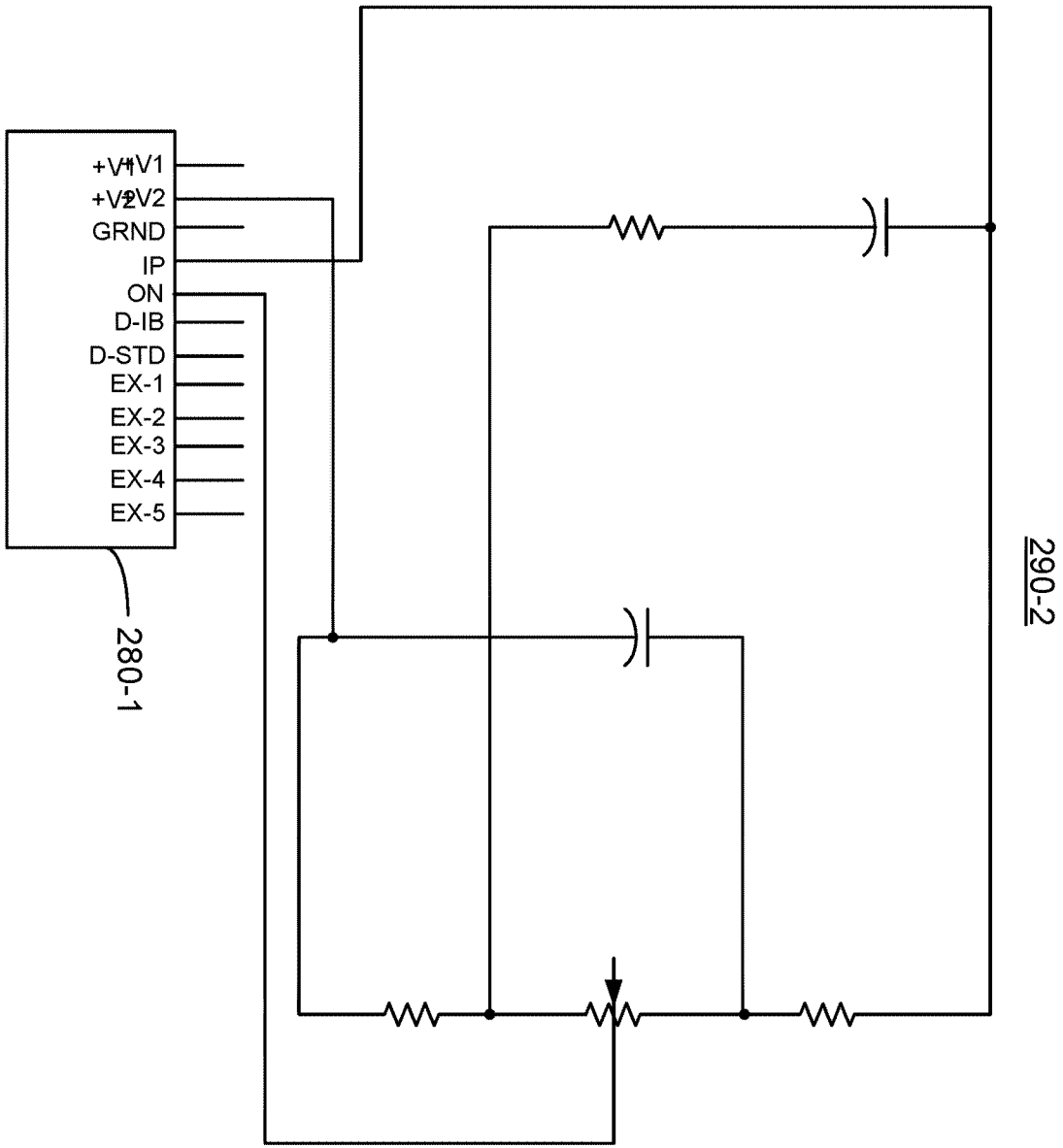
FIG. 12 is a schematic of another exemplary embodiment of an effects cartridge that provides tone adjustment for a modular music effects pedal.
Figure 13:
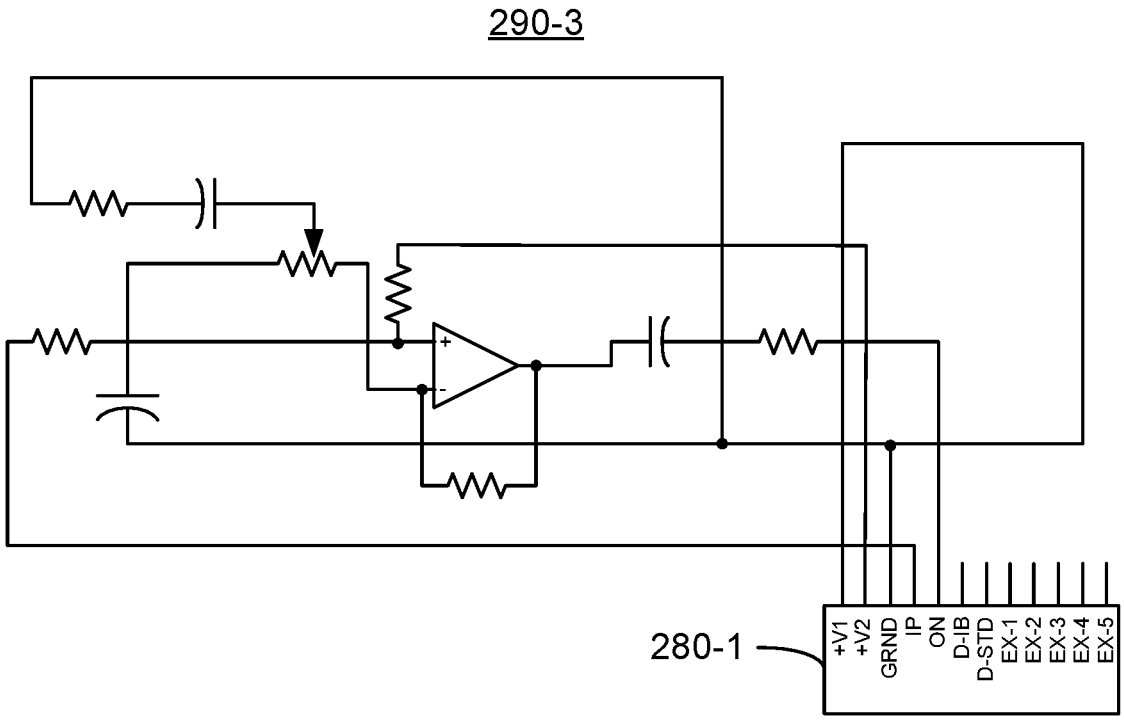
FIG. 13 is a schematic of another exemplary embodiment of an effects cartridge that provides tone adjustment for a modular music effects pedal.

Similarly, the tone cartridge 250-2 includes the connector 260-2 that is plugged into the connector 220-2 of the base 210. Also shown is user-customizable feature 254-2. FIGS. 11, 12 and 13 depict schematics of electronics 290-1, 290-2 and 290-3, respectively for implementations of the tone cartridge 250-2. Consequently, three different tone cartridges 250-2 might be coupled with the base 210.

Figure 14:
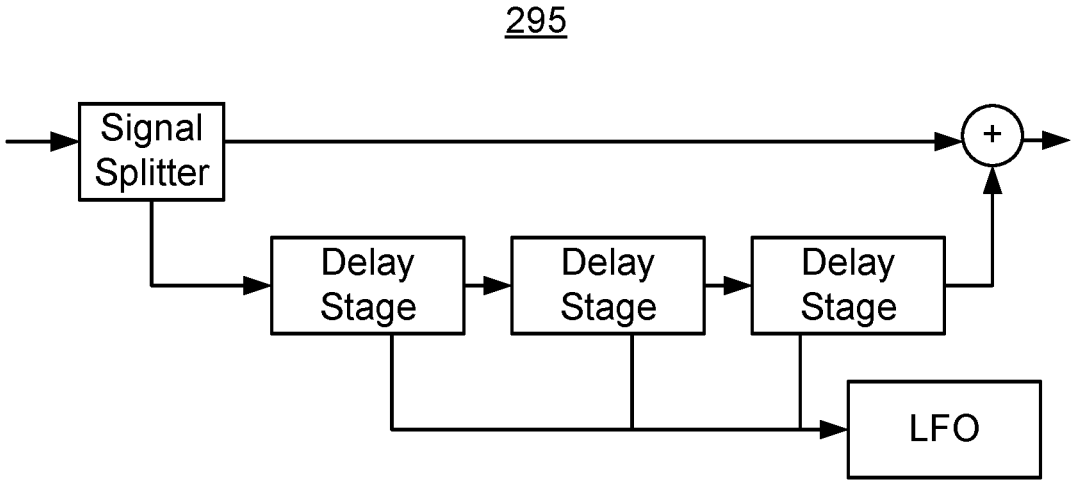
FIG. 14 is a schematic of another exemplary embodiment of an effects cartridge that provides a phaser for a modular music effects pedal.

FIG. 14 is a schematic at the block diagram level of an exemplary embodiments of phaser electronics 295 usable in the effects pedal 200. The phaser electronics includes a variable signal splitter, delay stages and a low frequency oscillator (LFO) that may modulate the delay stages. The delayed signal and unshifted signal are recombined and output. Thus, the phaser electronics 295 can be incorporated into an effects cartridge such as the cartridges 250-1, 250-2 and/or another cartridge.

Use of one of the three distortion cartridges 250-1 having electronics 280-1, 280-2 and 280-3 in conjunction with one of three tone cartridges 250-2 having electronics 290-1, 290-2 and 290-3 may provide a large number of combinations of distortion effects. The phaser electronics 295 might also be incorporated into the effects cartridges 250-1, 250-2 and/or another analogous effects cartridge. Such an effects cartridge may also be mixed/matched with a distortion cartridge 250-1 or a tone cartridge 250-2 using the electronics 280-1, 280-2, 280-3, 290-1, 290-2 or 290-3. Thus, a wide variety of effects might be provided for the pedal 200. Further, fine control may be achieved using the volume 219 on the base and features 254-1 and 254-2 on effects cartridges 250-1 and 250-2, respectively. The effects pedal 200 may allow users to easily, quickly and inexpensively obtain a high quality unique distortion and/or phaser effects.

Figure 15:
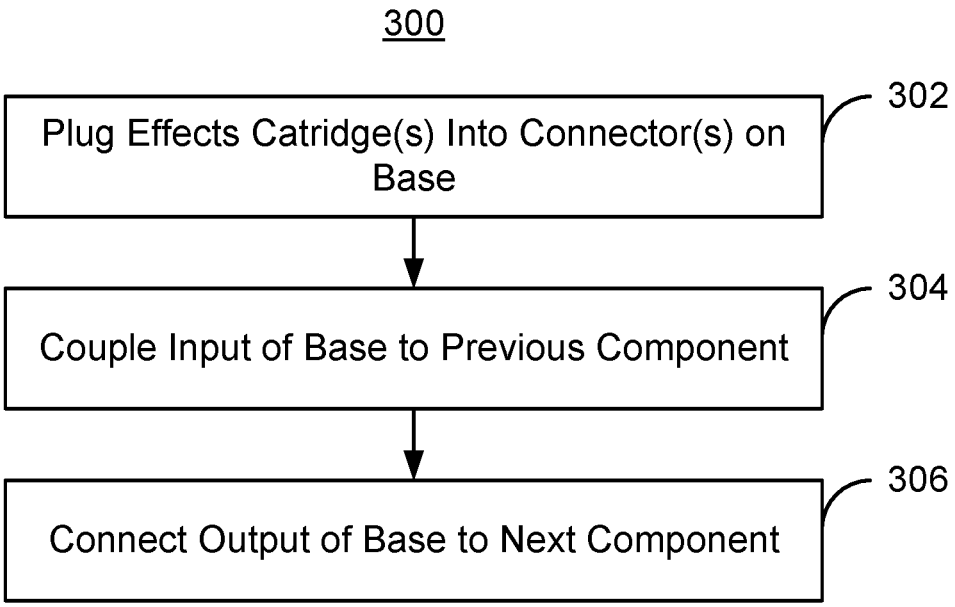
FIG. 15 is a flow chart depicting an exemplary embodiment of a method for using a modular music effects pedal.

FIG. 15 is a flow chart depicting an exemplary embodiment of a method 300 for using a modular music effects pedal. For simplicity, some steps may be omitted, performed in another order, include substeps and/or combined. The method 300 is described in the context of the effects pedal 200. However, the method 300 may be used with other analogous effects pedals including but not limited to the effects pedals 100, 100A, 100A' and/or 100A".

One or more effects cartridges are plugged into the appropriate connector(s) of the base, via step 302. For the pedal 200, the connector 260-1 of the distortion cartridge 250-1 may be plugged into the connector 220-1. The connector 260-2 of the tone cartridge 250-2 is plugged into the connector 260-2 of the base 210. If the connectors 260-1/220-1 and 260-2/220-2 include a locking mechanism, then this mechanism may be engaged as part of step 302. Engaging the locking mechanism might include the user performing a step, such as manipulating a lock or the effects pedal 200 automatically locking the cartridges 250-1 and 250-2 into place. However, such a locking mechanism is not permanent. Thus, the cartridges 250-1 and 250-2 might be replaced with other cartridges. Thus, step 302 completes formation of the effects pedal 200.

The input 212 of the base 210 is connected to the previous component, via step 304. Step 304 may include connecting the input 212 to a guitar, another instrument, another source of music, or another component for processing sound. Step 304 essentially provides a source of a signal that is to be processed using the effects pedal 200.

The output (not labeled in FIG. 6) of the effects pedal 200 is coupled with the next music processing component, via step 306. Step 306 might include the user connecting an amp to the effects pedal 200. Thus, the pedal may be used to provide customized effects for the user. The benefits of the effects pedal(s) 200, 100, 100A, 100A', 100A" and/or an analogous effects pedal may be achieved.

A method and system for providing and using a modular, user-customizable music effects pedal has been described. The method and system have been described in accordance with the exemplary embodiments shown, and one of ordinary skill in the art will readily recognize that there could be variations to the embodiments, and any variations would be within the spirit and scope of the method and system. Accordingly, many modifications may be made by one of ordinary skill in the art without departing from the spirit and scope of the appended claims.

We claim:

1. A music effects pedal comprising:

a base including an input for receiving a music signal;

a connector coupled with the input and having an electrical form factor and a physical form factor, the electrical form factor configured to fit a corresponding electrical form factor of an effects cartridge, the physical form factor configured to fit a corresponding physical form factor of the effects cartridge, the connector providing the music signal to the effects cartridge and receiving a processed signal from the effects cartridge; and an output coupled with the connector for providing an output signal, the output signal being based on the processed signal from the effects cartridge;

wherein the effects cartridge includes at least one user-customizable feature for altering the processed signal of the effects cartridge such that the music effects pedal includes a hierarchy of customizable effects, a first level in the hierarchy including selection of the effects cartridge from a plurality of effects cartridges, a second level of the hierarchy including the at least one user-customizable feature of the effects cartridge; and wherein the at least one user-customizable feature includes at least one of a switch and a dial, the switch having a plurality of positions including a first position and a second position, the first position connecting a plurality of circuit components to a signal path within the effects cartridge, the second position isolating the plurality of circuit components from the signal path, the dial for providing a variable effect of at least one circuit component of the effects cartridge.

2. The music effects pedal of claim 1 wherein the base further includes:

an additional connector coupled having an additional electrical form factor and an additional physical form factor, the additional electrical form factor configured to fit an additional corresponding electrical form factor of an additional effects cartridge, the additional physical form factor configured to fit an additional corresponding physical form factor of the additional effects cartridge, the additional connector providing the processed signal to the effects cartridge and receiving an additional processed signal from the effects cartridge, the additional processed signal being provide to the output such that the output signal is based on the additional processed signal from the additional effects cartridge.

3. The music effects pedal of claim 2 wherein the additional electrical form factor matches the electrical form factor and wherein the additional physical form factor matches the physical form factor.

4. The music effects pedal of claim 3 wherein the effects cartridge is a distortion cartridge and the additional effects cartridge is a tone cartridge.

5. The music effects pedal of claim 2 wherein at least one of the connector and the additional connector are configured such that the at least one of the connectors is electrically bypassed if the effects cartridge is not plugged into the connector and the additional connector is bypassed if the additional effects cartridge is not plugged into the additional connector.

6. The music effects pedal of claim 1 wherein the effects cartridge is selected from a distortion cartridge, a tone cartridge, a phaser cartridge, a reverb cartridge, a compressor cartridge, a filtering cartridge and a modulation cartridge.

7. The music effects pedal of claim 1 further comprising:

a power supply electrically coupled with the input, the output and the connector such that the power supply supplied power to the effects cartridge if the effects cartridge is coupled with the connector.

8. The music effects pedal of claim 1 wherein the music effects pedal is an analog music effects pedal.

9. An analog music effects pedal comprising:

a base including an input for receiving a music signal;

a connector coupled with the input and having an electrical form factor and a physical form factor, the electrical form factor configured to fit a corresponding electrical form factor of an effects cartridge, the physical form factor configured to fit a corresponding physical form factor of the effects cartridge; and an output coupled with the connector for providing an output signal, the output signal being based on the processed signal from the effects cartridge; and the effects cartridge coupled with the connector such that the connector provides the music signal to the effects cartridge and receives a processed signal from the effects cartridge, the effects cartridge including the effects cartridge electrical form factor, the effects cartridge physical form fact and effects electronics;

wherein the effects cartridge includes at least one user-customizable feature for altering the processed signal of the effects cartridge such that the music effects pedal includes a hierarchy of customizable effects, a first level in the hierarchy including selection of the effects cartridge from a plurality of effects cartridges, a second level of the hierarchy including the at least one user-customizable feature of the effects cartridge; and wherein the at least one user-customizable feature includes at least one of a switch and a dial, the switch having a plurality of positions including a first position and a second position, the first position connecting a plurality of circuit components to a signal path within the effects cartridge, the second position isolating the plurality of circuit components from the signal path, the dial for providing a variable effect of at least one circuit component of the effects cartridge.

10. The analog music effects pedal of claim 9 wherein the base further includes:

an additional connector coupled having an additional electrical form factor and an additional physical form factor, the additional electrical form factor configured to fit an additional corresponding electrical form factor of an additional effects cartridge, the additional physical form factor configured to fit an additional corresponding physical form factor of the additional effects cartridge, the additional connector providing the processed signal to the effects cartridge and receiving an additional processed signal from the effects cartridge, the additional processed signal being provided to the output such that the output signal is based on the additional processed signal from the additional effects cartridge.

11. The analog music effects pedal of claim 10 wherein the additional electrical form factor matches the electrical form factor and wherein the additional physical form factor matches the physical form factor.

12. The analog music effects pedal of claim 11 wherein the effects cartridge is a distortion cartridge and the additional effects cartridge is a tone cartridge.

13. The analog music effects pedal of claim 10 wherein at least one of the connector and the additional connector are configured such that the at least one of the connector is electrically bypassed if the effects cartridge is not plugged into the connector and the additional connector is bypassed if the additional effects cartridge is not plugged into the additional connector.

14. The analog music effects pedal of claim 9 further comprising:

a power supply electrically coupled with the input and integrated into the base, the output and the connector such that the power supply supplied power to the effects cartridge if the effects cartridge is coupled with the connector.

15. A method of using an analog music effects pedal including a base having an input and an output, the input for receiving a music signal, the method comprising:

plugging an effects cartridge into a connector of the base, the connector coupled with the input, being coupled with the output, and having an electrical form factor and a physical form factor, the electrical form factor configured to fit a corresponding electrical form factor of the effects cartridge, the physical form factor configured to fit a corresponding physical form factor of the effects cartridge, the cartridge being coupled with the connector such that the connector provides the music signal to the effects cartridge and receives a processed signal from the effects cartridge; and coupling the output with an additional music processing component, the output providing to the additional music processing component an output signal based on the processed signal from the effects cartridge;

wherein the effects cartridge includes at least one user-customizable feature for altering the processed signal of the effects cartridge such that the music effects pedal includes a hierarchy of customizable effects, a first level in the hierarchy including selection of the effects cartridge from a plurality of effects cartridges, a second level of the hierarchy including the at least one user-customizable feature of the effects cartridge; and wherein the at least one user-customizable feature includes at least one of a switch and a dial, the switch having a plurality of positions including a first position and a second position, the first position connecting a plurality of circuit components to a signal path within the effects cartridge, the second position isolating the plurality of circuit components from the signal path, the dial for providing a variable effect of at least one circuit component of the effects cartridge.

16. The method of claim 15 wherein the additional music processing component is an amplifier.

* * * * *